US009648421B2

(12) United States Patent
Keane et al.

(10) Patent No.: US 9,648,421 B2
(45) Date of Patent: May 9, 2017

(54) SYSTEMS AND METHODS FOR MATCHING GAIN LEVELS OF TRANSDUCERS

(75) Inventors: Anthony R. A. Keane, Webster, NY (US); Bryce Tennant, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 798 days.

(21) Appl. No.: 13/325,669

(22) Filed: Dec. 14, 2011

(65) Prior Publication Data

US 2013/0156224 A1 Jun. 20, 2013

(51) Int. Cl.
*G10L 21/0208* (2013.01)
*H04R 3/04* (2006.01)
*H04R 29/00* (2006.01)

(52) U.S. Cl.
CPC ..... *H04R 3/04* (2013.01); *H04R 29/004* (2013.01); *H04R 2430/01* (2013.01); *H04R 2430/03* (2013.01); *H04R 2499/11* (2013.01)

(58) Field of Classification Search
CPC ..... G10L 21/0208; G10L 2021/02087; H03G 3/32; H03G 3/341; H04H 40/72
USPC ..... 381/104, 107, 111–115, 97–98, 94.1
See application file for complete search history.

(56) References Cited

U.S. PATENT DOCUMENTS 3,728,633 A 4/1973 Krebs
4,225,976 A 9/1980 Osborne et al.
4,672,674 A 6/1987 Clough et al.
4,831,624 A 5/1989 McLaughlin et al.
5,224,170 A 6/1993 Waite, Jr.
5,226,178 A 7/1993 Eastmond et al.
5,260,711 A 11/1993 Sterzer
5,303,307 A 4/1994 Elko et al.
5,377,275 A 12/1994 Suzuki
5,381,473 A 1/1995 Andrea et al.
5,473,684 A 12/1995 Bartlett et al.
5,473,702 A 12/1995 Yoshida et al.
5,673,325 A 9/1997 Andrea et al.
5,732,143 A 3/1998 Andrea et al.
5,754,665 A 5/1998 Hosoi
5,838,269 A 11/1998 Xie
5,917,921 A 6/1999 Sasaki et al.
5,969,838 A 10/1999 Paritsky et al.
6,032,171 A 2/2000 Kiriaki et al.
6,061,456 A 5/2000 Andrea et al.
6,246,773 B1 6/2001 Eastty
(Continued)

OTHER PUBLICATIONS

International Search Report mailed Jun. 30, 2011, in application serial No. PCT/US2010/026886, in the name of Harris Corporation.
(Continued)

*Primary Examiner* — George Monikang
(74) *Attorney, Agent, or Firm* — Fox Rothschild LLP; Robert J. Sacco; Carol E. Thorstad-Forsyth

(57) ABSTRACT

A method (100) for matching characteristics of two or more transducer systems (202, 208). The method involving: receiving input signals from a set of said transducer systems; determining if the input signals contain a pre-defined portion of a common signal which is the same at all of said transducer systems; and balancing the characteristics of the transducer systems when it is determined that the input signals contain the pre-determined portion of the common signal.

25 Claims, 10 Drawing Sheets

(56) References Cited

U.S. PATENT DOCUMENTS 6,501,739 B1 12/2002 Cohen
6,549,586 B2 4/2003 Gustafsson et al.
6,564,184 B1 5/2003 Eriksson
6,577,966 B2 6/2003 Balan et al.
6,654,468 B1 11/2003 Thompson
6,674,865 B1 1/2004 Venkatesh et al.
6,766,190 B2 7/2004 Ferek-Petric
6,868,365 B2 3/2005 Balan et al.
6,912,387 B2 6/2005 Haas et al.
6,917,688 B2 7/2005 Yu et al.
6,963,649 B2 11/2005 Vaudrey et al.
6,978,010 B1 12/2005 Short et al.
7,065,206 B2 6/2006 Pan
7,092,529 B2 8/2006 Yu et al.
7,146,013 B1 12/2006 Saito et al.
7,191,127 B2 3/2007 Lorenzo et al.
7,206,418 B2 4/2007 Yang et al.
7,248,708 B2 7/2007 Vaudrey et al.
7,274,794 B1 9/2007 Rasmussen
7,346,176 B1 3/2008 Bernardi et al.
7,359,504 B1 4/2008 Reuss et al.
7,415,294 B1 8/2008 Zhang et al.
7,433,463 B2 10/2008 Alves et al.
7,464,029 B2 12/2008 Visser et al.
7,474,755 B2 * 1/2009 Niederdrank ..... H04R 25/356 381/102
7,477,751 B2 1/2009 Lyon et al.
7,561,700 B1 7/2009 Bernardi et al.
7,688,985 B2 3/2010 Roeck
7,697,700 B2 4/2010 Mao
7,751,575 B1 7/2010 Baumhauer, Jr. et al.
7,826,623 B2 11/2010 Christoph
7,864,969 B1 1/2011 Ma et al.
7,876,918 B2 1/2011 Luo
7,961,869 B1 6/2011 Zhang et al.
7,983,720 B2 7/2011 Chen
7,983,907 B2 7/2011 Visser et al.
2002/0048377 A1 4/2002 Vaudrey et al.
2002/0116187 A1 8/2002 Erten
2002/0193130 A1 12/2002 Yang et al.
2003/0228023 A1 12/2003 Burnett et al.
2005/0031136 A1 2/2005 Du et al.
2005/0136848 A1 6/2005 Murray
2005/0190927 A1 * 9/2005 Petroff ..... H03G 3/32 381/59
2006/0002570 A1 1/2006 Vaudrey et al.
2006/0013412 A1 1/2006 Goldin
2006/0120537 A1 6/2006 Burnett et al.
2006/0133621 A1 6/2006 Chen et al.
2006/0133622 A1 6/2006 Chen
2006/0135085 A1 6/2006 Chen
2006/0154623 A1 7/2006 Chen et al.
2006/0210058 A1 9/2006 Kock et al.
2007/0086603 A1 4/2007 Lyon et al.
2007/0116300 A1 5/2007 Chen
2007/0127736 A1 6/2007 Christoph
2007/0127759 A1 6/2007 Zhang et al.
2007/0189561 A1 8/2007 Dijkstra et al.
2007/0189564 A1 8/2007 McBagonluri et al.
2007/0262819 A1 * 11/2007 Jin ..... H03G 3/32 330/278
2007/0274552 A1 11/2007 Konchitsky et al.
2008/0013770 A1 1/2008 Wu et al.
2008/0019548 A1 1/2008 Avendano
2008/0044036 A1 2/2008 Konchitsky
2008/0175408 A1 7/2008 Mukund et al.
2008/0201138 A1 8/2008 Visser et al.
2008/0260175 A1 10/2008 Elko
2008/0269926 A1 10/2008 Xiang et al.
2009/0003640 A1 1/2009 Burnett
2009/0010449 A1 1/2009 Burnett
2009/0010450 A1 1/2009 Burnett
2009/0010451 A1 1/2009 Burnett
2009/0010453 A1 1/2009 Zurek et al.
2009/0089053 A1 4/2009 Wang et al.
2009/0089054 A1 4/2009 Wang et al.
2009/0111507 A1 4/2009 Chen
2009/0154692 A1 * 6/2009 Sakuraba ..... H04M 9/082 379/406.06
2009/0154715 A1 6/2009 Lyon et al.
2010/0046770 A1 2/2010 Chan et al.
2010/0098266 A1 4/2010 Mukund et al.
2010/0215191 A1 * 8/2010 Yoshizawa ..... G10L 21/0208 381/94.2
2010/0232616 A1 9/2010 Chamberlain et al.
2011/0064240 A1 * 3/2011 Litvak ..... A61N 1/36032 381/94.1
2011/0106533 A1 5/2011 Yu
2011/0176690 A1 * 7/2011 Takano ..... H04R 3/005 381/92
2011/0188687 A1 * 8/2011 Song ..... H04R 25/00 381/321
2012/0230527 A1 * 9/2012 Gable ..... H01M 2/0202 381/323
2012/0316872 A1 * 12/2012 Stoltz ..... G10L 21/0216 704/233

OTHER PUBLICATIONS

Boll, Steven F., "Suppression of Acoustic Noise in Speech Using Spectral Subtraction", IEEE Transactions on Acoustics, Speech, and Signal Processing, vol. ASSP-27, No. 2, Apr. 1979.
Widrow, et al., "Adaptive Noise Cancelling: Principles and Applications", Proceedings of the IEEE, vol. 63, No. 12, Dec. 1975, pp. 1692-1716.

* cited by examiner

SYSTEMS AND METHODS FOR MATCHING GAIN LEVELS OF TRANSDUCERS

BACKGROUND OF THE INVENTION

Statement of the Technical Field

The invention concerns transducer systems. More particularly, the invention concerns transducer systems and methods for matching gain levels of the transducer systems.

Description of the Related Art

There are various conventional systems that employ transducers. Such systems include, but are not limited to, communication systems and hearing aid systems. These systems often employ various noise cancellation techniques to reduce or eliminate unwanted sound from audio signals received at one or more transducers (e.g., microphones).

One conventional noise cancellation technique uses a plurality of microphones to improve speech quality of an audio signal. For example, one such conventional multi-microphone noise cancellation technique is described in the following document: B. Widrow, R. C. Goodlin, et al., *Adaptive Noise Cancelling: Principles and Applications*, Proceedings of the IEEE, vol. 63, pp. 1692-1716, December 1975. This conventional multi-microphone noise cancellation technique uses two (2) microphones to improve speech quality of an audio signal. A first one of the microphones receives a "primary" input containing a corrupted signal. A second one of the microphones receives a "reference" input containing noise correlated in some unknown way to the noise of the corrupted signal. The "reference" input is adaptively filtered and subtracted from the "primary" input to obtain a signal estimate.

In the above-described multi-microphone noise cancellation technique, the noise cancellation performance depends on the degree of match between the two microphone systems. The balance of the gain levels between the microphone systems is important to be able to effectively remove far field noise from an input signal. For example, if the gain levels of the microphone systems are not matched, then the amplitude of a signal received at the first microphone system will be amplified by a larger amount as compared to the amplitude of a signal received at the second microphone system. In this scenario, a signal resulting from the subtraction of the signals received at the two microphone systems will contain some unwanted far field noise. In contrast, if the gain levels of the microphone systems are matched, then the amplitudes of the signals received at the microphone systems are amplified by the same amount. In this scenario, a signal resulting from the subtraction of signals received at the microphone systems is absent of far field noise.

The following table illustrates how well balanced the gain levels of the microphone systems have to be to effectively remove far field noise from a received signal.

| Microphone Difference (dB) | Noise Suppression (dB) |
|---|---|
| 1.00 | 19.19 |
| 2.00 | 13.69 |
| 3.00 | 10.66 |
| 4.00 | 8.63 |
| 5.00 | 7.16 |
| 6.00 | 6.02 |

For typical users, a reasonable noise rejection performance is nineteen to twenty decibels (19 dB to 20 dB) of noise rejection. In order to achieve the minimum acceptable noise rejection, microphone systems are needed with gain tolerances better than +/−0.5 dB, as shown in the above provided table. Also, the response of the microphones must also be within this tolerance across the frequency range of interest (e.g., 300 Hz to 3500 Hz) for voice. The response of the microphones can be affected by acoustic factors, such as port design which may be different between the two microphones. In this scenario, the microphone systems need to have a difference in gain levels equal to or less than 1 dB. Such microphones are not commercially available. However, microphones with gain tolerances of +/−1 dB and +/−3 dB do exist. Since the microphones with gain tolerances of +/−3 dB are less expensive and more available as compared to the microphones with gain tolerances of +/−1 dB, they are typically used in the systems employing the multi-microphone noise cancellation techniques. In these conventional systems, a noise rejection better than 6 dB cannot be guaranteed as shown in the above provided table. Therefore, a plurality of solutions have been derived for providing a noise rejection better than 6 dB in systems employing conventional microphones.

A first solution involves utilizing tighter tolerance microphones, e.g., microphones with gain tolerances of +/−1 dB. In this scenario, the amount of noise rejection is improved from 6 dB to approximately 14 dB, as shown by the above provided table. Although the noise rejection is improved, this first solution suffers from certain drawbacks. For example, the tighter tolerance microphones are more expensive as suggested above, and long term drift can, over time, cause performance degradation.

A second solution involves calibrating the microphone systems at the factory. The calibration process involves: manually adjusting a sensitivity of the microphone systems such that they meet the +/−0.5 dB gain difference specification; and storing the gain adjustment values in the device. This second solution suffers from certain drawbacks. For example, the cost of manufacture is relatively high as a result of the calibration process. Also, there is an inability to compensate for drifts and changes in system characteristics which occur overtime.

A third solution involves performing a Least Means Squares (LMS) based solution or a time domain solution. The LMS based solution involves adjusting taps on a Finite Impulse Response (FIR) filter until a minimum output occurs. The minimum output indicates that the gain levels of the microphone systems are balanced. This third solution suffers from certain drawbacks. For example, this solution is computationally intensive. Also, the time it takes to acquire a minimum output can be undesirably long.

A fourth solution involves performing a trimming algorithm based solution. The trimming algorithm based solution is similar to the factory calibration solution described above. The difference between these two solutions is who performs the calibration of the transducers. In the factory calibration solution, an operator at the factory performs said calibration. In the trimming algorithm based solution, the user performs said calibration. One can appreciate that the trimming algorithm based solution is undesirable since the burden of calibration is placed on the user and the quality of the results are likely to vary.

SUMMARY OF THE INVENTION

Embodiments of the present invention concern implementing systems and methods for matching characteristics of two or more transducer systems. The methods generally involve: receiving input signals from a set of transducer systems; determining if the input signals contain a pre-defined portion of a common signal which is the same at all of the transducer systems; and balancing the characteristics of the transducer systems when it is determined that the input signals contain the pre-determined portion of the common signal. The common signal can include, but is not limited to, a far field acoustic noise signal or a parameter which is common to the transducer systems.

According to aspects of the present invention, the methods also involve: dividing a spectrum into a plurality of frequency bands; and processing each of the frequency bands separately for addressing differences between operations of the transducer systems at different frequencies. According to other aspects of the present invention, the transducer systems emit changing direct current signals. In this scenario, the direct current signals may represent an oxygen reading.

According to aspects of the present invention, the balancing is achieved by: constraining an amount of adjustment of a gain so that differences between gains of the transducer systems are less than or equal to a pre-defined value; and/or constraining an amount of adjustment of a phase so that differences between phases of said transducer systems are less than or equal to a pre-defined value. The gain of each transducer system can be adjusted by incrementing or decrementing a value of the same. Similarly, the phase of each transducer system is adjusted by incrementing or decrementing a value of the same.

Notably, characteristics of a first one of the transducer systems may be used as reference characteristics for adjustment of the characteristics of a second one of the transducer systems. Also, the gain and phase adjustment operations may be disabled by a noise floor detector or a wanted signal detector when triggered. The wanted signal detected includes, but is not limited to, a voice signal detector. The wanted signal is detected by the wanted signal detector when an imbalance in signal output levels of the transducer systems occurs.

Other embodiments of the present invention concern implementing systems and methods for matching gain levels of at least a first transducer system and a second transducer system. The methods generally involve receiving a first input signal at the first transducer system and receiving a second input signal at the second transducer system. Thereafter, a determination is made as to whether or not the first and second input signals contain only far field noise (i.e., does not include any wanted signal). If it is determined that the first and second input signals contain only far field noise and that the signal level is reasonable above the system noise floor, then the gain level of the second transducer system is adjusted relative to the gain level of the first transducer system. The adjustment of the gain level can be achieved by incrementing or decrementing the gain level of the second transducer system by a certain amount, allowing the algorithm to trim gradually in the background and ride through chaotic conditions without disrupting wanted signals. Additionally, the amount of adjustment of the gain level is constrained so that a difference between the gain levels of the first and second transducer systems is less than or equal to a pre-defined value (e.g., 6 dB) to ensure that the algorithm does not move into an un-tractable area. If it is determined that the first and second input signals do not contain far field noise, then the gain level of the second transducer system is left alone.

The method can also involve determining if the gain levels of the first and second transducer systems are matched. In this scenario, the gain level of the second transducer system is adjusted if (a) it is determined that the first and second input signals contain far field noise, and (b) it is determined that the gain levels of the first and second transducer systems are not matched.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
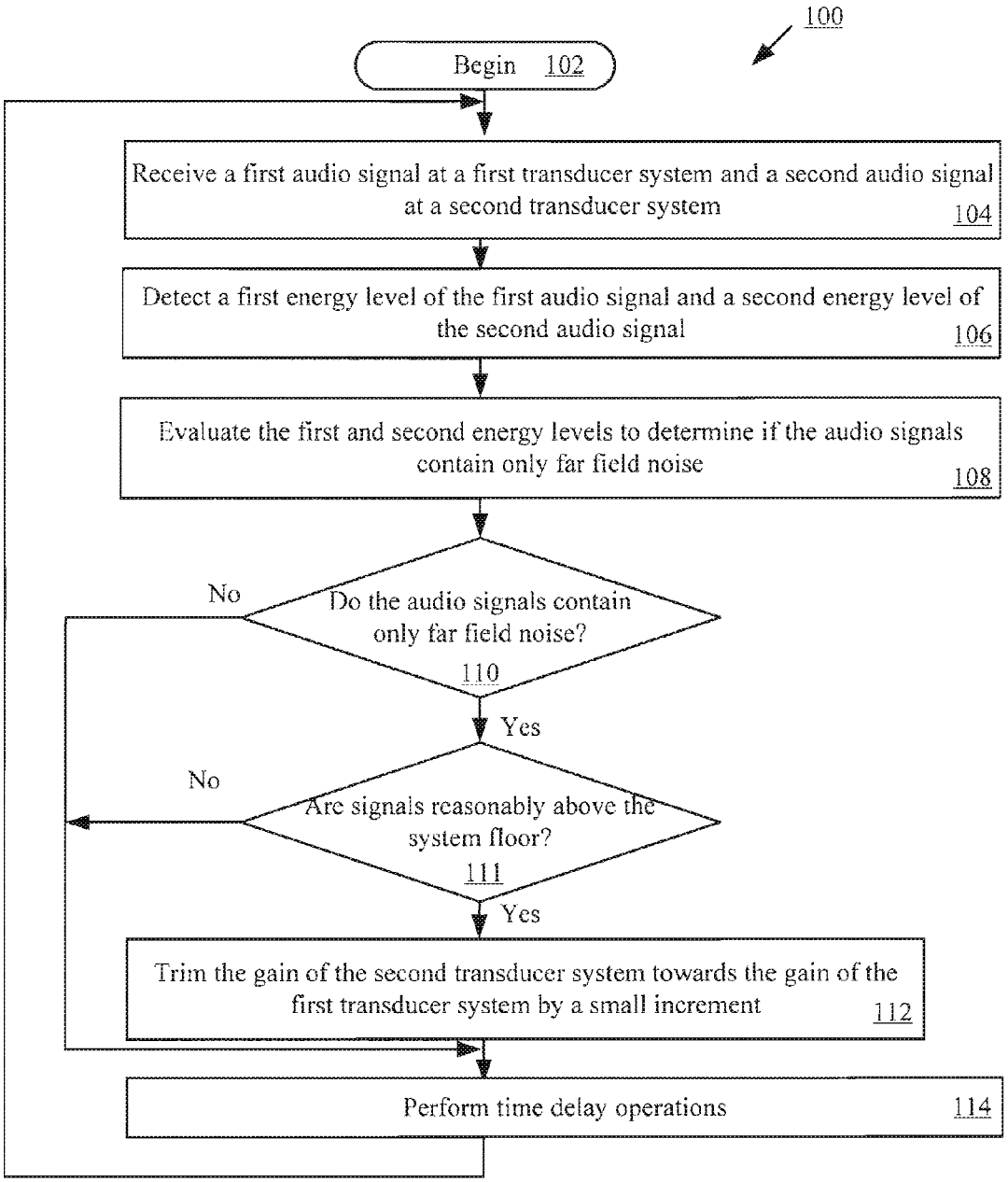
FIG. 1 is a flow diagram of an exemplary method for transducer matching that is useful for understanding the present invention.

The present invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention. Embodiments of the present invention are not limited to those detailed in this description.

Embodiments of the present invention generally involve implementing systems and methods for balancing transducer systems or matching gain levels of the transducer systems. The method embodiments of the present invention overcome certain drawbacks of conventional transducer matching techniques, such as those described above in the background section of this document. For example, the method embodiments of the present invention provides transducer systems that are less expensive to manufacture as compared to the conventional systems comprising transducers with +/−1 dB gain tolerances and/or transducers that are manually calibrated at a factory. Also, implementations of the present invention are less computationally intensive and expensive as compared to the implementations of conventional LMS solutions. The present invention is also more predictable as compared to the conventional LMS solutions. Furthermore, the present invention does not require a user to perform calibration of the transducer systems for matching gain levels thereof.

The present invention generally involves adjusting the gain of a first transducer system relative to the gain of a second transducer system. The second transducer system has a higher speech-to-noise ratio as compared to the first transducer system. The gain of the first transducer system is adjusted by performing operations in the frequency domain or the time domain. The operations are generally performed for adjusting the gain of the first transducer system when only far field noise components are present in the signals received and reasonably above the system noise floor at the first and second transducer systems. The signals exclusively containing far field noise components are referred to herein as "far field noise signals". Signals containing wanted, (typically speech) components are referred to herein as "voice signals". If the gains of the transducer systems are matched, then the energy of signals output from the transducer systems are the same as or substantially similar when far field noise only signals are received thereat. Accordingly, a difference between the gains of "unmatched" transducer systems can be accurately determined when far field noise only signals are received thereat. In contrast, the energy of signals output from "matched" transducer systems are different by a variable amount when voice signals are received thereat. The amount of difference between the signal energies depends on various factors (e.g., the distance of each transducer from the source of the speech and the volume of a person's voice). As such, a difference between the gains of "unmatched" transducer systems can not be accurately determined when voice signals are received thereat.

The present invention can be used in a variety of applications. Such applications include, but are not limited to, communication system applications, voice recording applications, hearing aid applications and any other application in which two or more transducers need to be balanced. The present invention will now be described in relation to FIGS. 1-10. More specifically, exemplary method embodiments of the present invention will be described below in relation to FIG. 1. Exemplary implementing systems will be described in relation to FIGS. 2-10.

Exemplary Method and System Embodiments of the Present Invention

Referring now to FIG. 1, there is provided a flow diagram of an exemplary method 100 that is useful for understanding the present invention. The goal of method 100 is to match the gain of two or more transducer systems (e.g., microphone systems) or decrease the difference between gains of the transducer systems. Such a method 100 is useful in a variety of applications, such as noise cancellation applications. In the noise cancellation applications, the method 100 provides noise error amplitude reduction systems with improved noise cancellation as compared to conventional noise error amplitude reduction systems.

As shown in FIG. 1, the method 100 begins with step 102 and continues with step 104. In step 104, a first audio signal is received at a first transducer system. Step 104 also involves receiving a second audio signal at a second transducer system. Each of the first and second transducer systems can include, but is not limited to, a transducer (e.g., a microphone) and an amplifier. The first audio signal has a relatively high speech-to-noise ratio as compared to the speech-to-noise ratio of the second audio signal.

After receiving the first audio signal and the second audio signal, the method 100 continues with step 106. In step 106, first and second energy levels are determined. The first energy level is determined using at least a portion of the first audio signal. The second energy level is determined using at least a portion of the second audio signal. Methods of determining energy levels for a signal are well known to persons skilled in the art, and therefore will not be described herein. Any such method can be used with the present invention without limitation.

Figure 9:
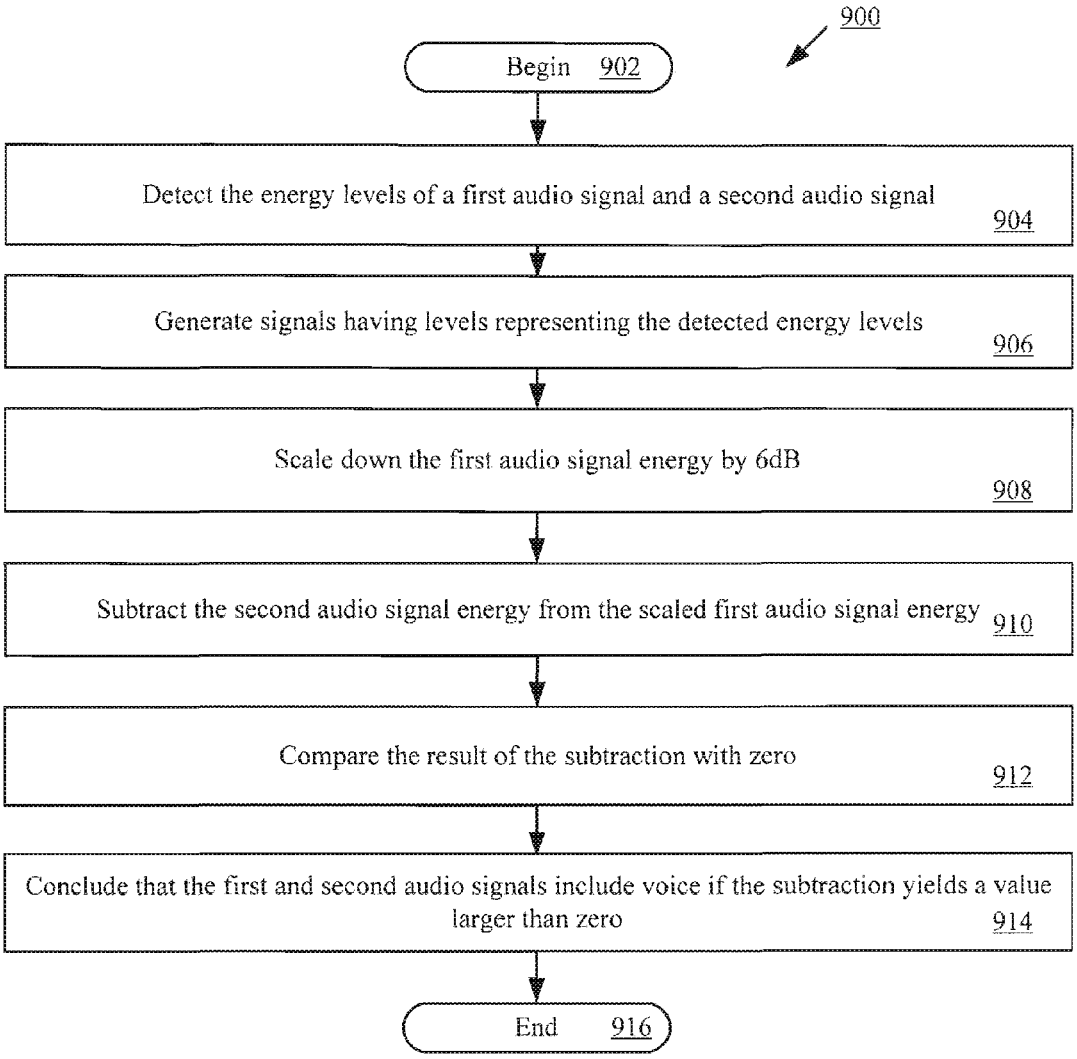
FIG. 9 is a flow diagram of an exemplary method for determining if an audio signal includes voice.
Figure 10:
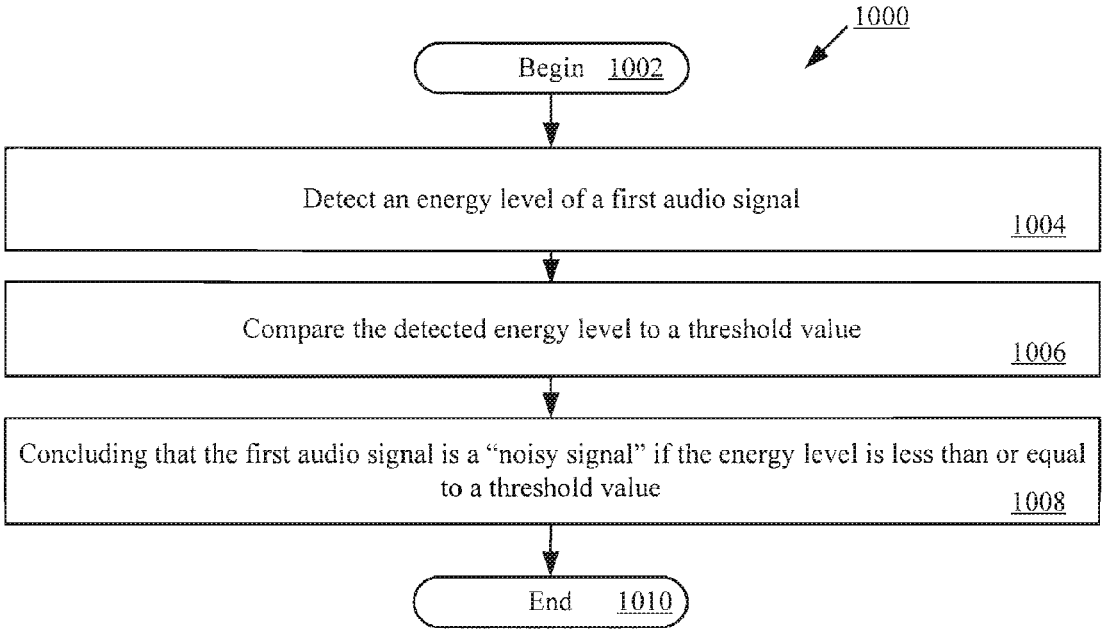
FIG. 10 is a flow diagram of an exemplary method for determining if an audio signal is a low energy signal.

In a next step 108, the first and second energy levels are evaluated. The evaluation is performed for determining if the first audio signal and the second audio signal contain only far field noise. This evaluation can be achieved by (a) determining if the first audio signal includes voice and/or (b) determining if the first audio signal is a low energy signal (i.e., has an energy level equal to or below a noise floor level). Signals with energy levels equal to or less than a noise floor are referred to herein as "noisy signals". Noisy signals may contain low volume speech or just low level system noise. If (a) and/or (b) are not met, then the first and second audio signals are determined to include only far field noise. As shown in FIG. 9, determination (a) can be achieved by performing steps 902-916. Steps 904-914 generally involve: detecting the energy levels of the first audio signal and the second audio signal; generating signals having levels representing the detected energy levels; appropriately scaling the energy levels (e.g., scale down the first audio signal energy by 6 dB); subtracting the scaled energy levels to obtain a combined signal; comparing the combined signal to zero; and concluding that the first and second audio signals include voice if the magnitude exceeds zero. As shown in FIG. 10, determination (b) can be achieved by performing steps 1002-1010. Steps 1004-1008 generally involve: detecting an energy level of the first audio signal; comparing the detected energy level to a threshold value; and concluding that the first audio signal is a "noisy signal" if the energy level is less than or equal to a predetermined threshold value.

Referring again to FIG. 1, the method 100 continues with decision steps 110 and 111 after completing step 108. If it is determined that the first and second audio signals include voice or that the first audio signal is a "noisy signal" [110:NO or 111:NO], then the method 100 continues to step 114. In contrast, if it is determined that the first and second audio signals include only far field noise [110:YES and 111:YES], then step 112 is performed. In step 112, the gain of the second transducer system is trimmed towards the gain of the first transducer system by a small increment. Thereafter, step 114 is performed where time delay operations are performed which determine the rate at which the trimming operation is performed. After completing step 114, the method 100 returns to step 104.

Figure 2:
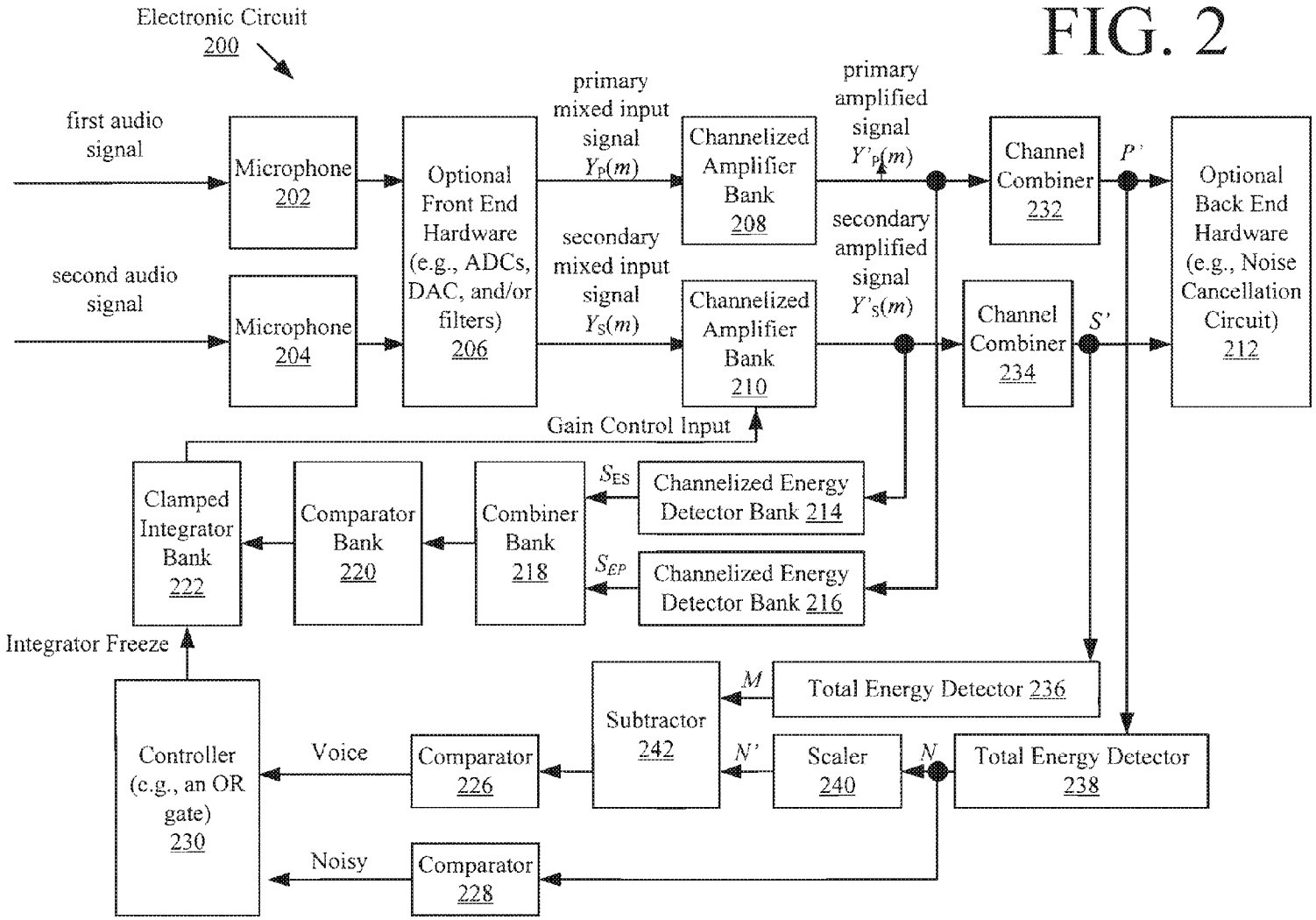
FIG. 2 is a block diagram of an exemplary electronic circuit implementing the method of FIG. 1 that is useful for understanding the present invention.

Referring now to FIG. 2, there is provided a block diagram of an implementation of the above described method 100. As shown in FIG. 2, the method 100 is implemented by an electronic circuit 200. The electronic circuit 200 is generally configured for matching the gain of two or more transducer systems or decreasing the difference between gains of the transducer systems. The electronic circuit 200 can comprise only hardware or a combination of hardware and software. As shown in FIG. 2, the electronic circuit 200 includes microphones 202, 204, optional front end hardware 206, at least one channelized amplifier 208, 210, channel combiners 232, 234 and optional back end hardware 212. The electronic circuit 200 also includes at least one channelized energy detector 214, 216, a combiner bank 218, a comparator bank 220 and a clamped integrator bank 222. The electronic circuit 200 additionally includes total energy detectors 236, 238, scaler 240, subtractor 242, comparators 226, 228 and a controller 230. Notably, the present invention is not limited to the architecture shown in FIG. 2. The electronic circuit 200 can include more or less components than those shown in FIG. 2. For example, the electronic circuit 200 can be absent of front end hardware 206 and/or back end hardware 212.

The microphones 202, 204 are electrically connected to the front end hardware 206. The front end hardware 206 can include, but is not limited to, Analog to Digital Convertors (ADCs), Digital to Analog Converters (ADCs), filters, codecs, and/or Field Programmable Gate Arrays (FPGAs). The outputs of the front end hardware 206 are a primary mixed input signal $Y_P(m)$ and a secondary mixed input signal $Y_S(m)$. The primary mixed input signal $Y_P(m)$ can be defined by the following mathematical equation (1). The secondary mixed input signal $Y_S(m)$ can be defined by the following mathematical equation (2).

$$Y_P(m)=x_P(m)+n_P(m) \tag{1}$$

$$Y_S(m)=x_S(m)+n_S(m) \tag{2}$$

where $Y_P(m)$ represents the primary mixed input signal. $x_P(m)$ represents a speech waveform contained in the primary mixed input signal. $n_P(m)$ represents a noise waveform contained in the primary mixed input signal. $Y_S(m)$ represents the secondary mixed input signal. $x_S(m)$ represents a speech waveform contained in the secondary mixed input signal. $n_S(m)$ represents a noise waveform contained in the secondary mixed input signal. The primary mixed input signal $Y_P(m)$ has a relatively high speech-to-noise ratio as compared to the speech-to-noise ratio of the secondary mixed input signal $Y_S(m)$. The first transducer system 202, 206, 208 has a high speech-to-noise ratio as compared to the second transducer system 204, 206, 210. The high speech-to-noise ratio may be a result of spacing between the microphones 202, 204 of the first and second transducer systems.

The high speech-to-noise ratio of the first transducer system 202, 206, 208 may be provided by spacing the microphone 202 of first transducer system a distance from the microphone 204 of the second transducer system, as described in U.S. Ser. No. 12/403,646. The distance can be selected so that a ratio between a first signal level of far field noise arriving at microphone 202 and a second signal level of far field noise arriving at microphone 204 falls within a pre-defined range (e.g., +/−3 dB). For example, the distance between the microphones 202, 204 can be configured so that the ratio falls within the pre-defined range. Alternatively or additionally, one or more other parameters can be selected so that the ratio falls within the pre-defined range. The other parameters can include, but are not limited to, a transducer field pattern and a transducer orientation. The far field sound can include, but is not limited to, sound emanating from a source residing a distance of greater than three (3) or six (6) feet from the microphones 202, 204.

As shown in FIG. 2, the primary mixed input signal $Y_P(m)$ is communicated to the channelized amplifier 208 where it is split into one or more frequency bands and amplified so as to generate a primary amplified signal bank $Y'_P(m)$. Similarly, the secondary mixed input signal $Y_S(m)$ is communicated to the channelized amplifier 210 where it is split into one or more frequency bands and amplified so as to generate a secondary amplified signal bank $Y'_S(m)$. The amplified signals $Y'_P(m)$ and $Y'_S(m)$ are then combined back together with channel combiners 232, 234 and passed to the back end hardware 212 for further processing. The back end hardware 212 can include, but is not limited to, a noise cancellation circuit.

Notably, the gains of the amplifiers in the channelized amplifier bank 210 are dynamically adjusted during operation of the electronic circuit 200. The dynamic gain adjustment is performed for matching the transducer 202, 204 sensitivities across the frequency range of interest. As a result of the dynamic gain adjustment, the noise cancellation performance of the back end hardware 212 is improved as compared to a noise cancellation circuit absent of a dynamic gain adjustment feature. The dynamic gain adjustment is facilitated by components 214-230 and 236-242 of the electronic circuit 200. The operations of components 214-230 and 236-242 will now be described in detail.

During operation, the channelized energy detector 216 detects the energy level $-E_P$ of each channel of the primary amplified signal $Y'_P(m)$, and generates a set of signals $S_{EP}$ with levels representing the values of the detected energy levels $-E_P$. Similarly, the channelized energy detector 214 detects the energy level $+E_S$ of each channel of the secondary amplified signal $Y'_S(m)$, and generates a set of signals $S_{ES}$ with levels representing the values of the detected energy levels $+E_S$. The signals $S_{EP}$ and $S_{ES}$ are combined by combiner bank 218 to generate a set of combined signals S'. The combined signals S' are communicated to the comparator bank 220. The channelized energy detectors 214, 216 can include, but are not limited to, filters, rectifiers, integrators and/or software. The comparator bank 220 can include, but is not limited to, operational amplifiers, voltage comparators, and/or software.

At the comparator bank 220, the levels of the combined signals S' are compared to a threshold value (e.g., zero). If the level of one of the combined signals S' is greater than the threshold value, then that comparator within the comparator bank 220 outputs a signal to cause its associate amplifier, within the channelized amplifier bank 210 to increment its gain by a small amount. If the voltage level of one of the combined signals S' is less than the threshold value, then that comparator within the comparator bank 220 outputs a signal to cause its associated amplifier, within the channelized amplifier bank 210 to decrement its gain by a small amount.

The signals output from the comparator bank 220 are communicated to the clamped integrator bank 222. The clamped integrator bank 222 is generally configured for controlling the gains of the channelized amplifier bank 210. The clamping provided by the clamped integrator bank 222 is designed to limit the range of gain control relative to channelized amplifier bank 208 (e.g., +/−3 dB). In this regard, the clamped integrator bank 222 sends a gain control input signal to the channelized amplifier bank 210 for selectively incrementing or decrementing the gain of channelized amplifier bank 210 by a certain amount. The amount by which the gain is changed can be defined by a pre-stored value (e.g., 0.01 dB). The clamped integrator bank 222 will be described in more detail below in relation to FIG. 3.

The clamped integrator bank 222 is selectively enabled and disabled based on the results of a determination as to whether or not the signals $Y_P(m)$, $Y_S(m)$ include only far field noise and are not "noisy". The determination is made by components 226-230 and 236-242 of the electronic circuit 200. The operation of components 226-230 and 236-242 will now be described.

The total energy detector 236 detects the magnitude M of the combined signal S' output from channel combiner 234. The total energy detector 238 detects the magnitude N of the combined signal P' output from the channel combiner 234. The magnitude N is scaled by a scaler 240 (e.g., reduced 6 dB) predetermined to give good voice detection performance to generate the value N'. The value M is subtracted from the value N' in subtractor 242 and the result is communicated to the comparator 226 where it's level is compared to zero. If the level exceeds zero, then it is determined that the signals $Y_P(m)$ and $Y_S(m)$ include voice. In this scenario, the comparator 226 outputs a signal with a level (e.g., 1.0) indicating that the signals $Y_P(m)$ and $Y_S(m)$ include voice. The comparator 226 can include, but is not limited to, operational amplifiers, voltage comparators and/or software. If the level is less than zero, then it is determined that the signals $Y_P(m)$ and $Y_S(m)$ do not include voice. In this scenario, the comparator 226 outputs a signal with a level (e.g., 0.0) indicating that the signals $Y_P(m)$ and $Y_S(m)$ do not include voice.

The comparator 228 compares the level of value N output from the total energy detector 238 to a threshold value (e.g., 0.1). If the level of value N is less than the threshold value, then it is determined that the signal $Y_P(m)$ has an energy level below a noise floor level, and therefore is a "noisy" signal which may include low volume speech. In this scenario, the comparator 228 outputs a signal with a level (e.g., 1.0) indicating that the signal $Y_P(m)$ is "noisy". If the level of N is equal to or greater than the threshold value, then it is determined that the signal $Y_P(m)$ has an energy level above the noise floor level and is not "noisy". In this scenario, the comparator 228 outputs a signal with a level (e.g., 1.0) indicating that the signal $Y_P(m)$ has an energy level above the noise floor level and is not "noisy". The comparator 228 can include, but is not limited to, operational amplifiers, voltage comparators, and/or software.

The signals output from comparators 226, 228 are communicated to the controller 230. The controller 230 enables the clamped integrator bank 222 when the signals $Y_P(m)$ and $Y_S(m)$ include only far field noise. The controller 230 freezes the values in the clamped integrator bank 222 when: the signal $Y_P(m)$ is "noisy"; and/or the signals $Y_P(m)$ and $Y_S(m)$ include voice. The controller 230 can include, but is not limited to, an OR gate and/or software.

Figure 3:
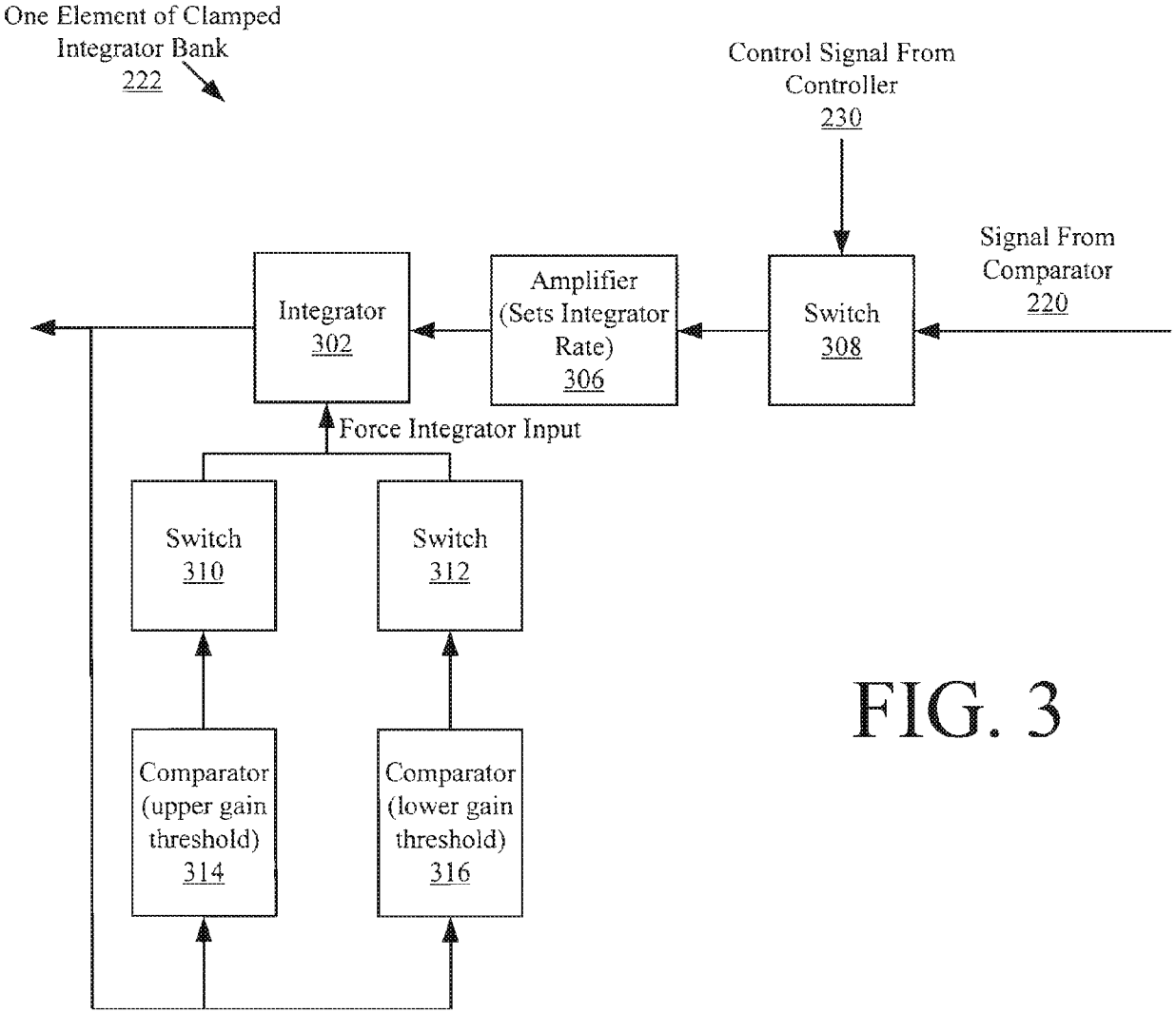
FIG. 3 is a block diagram of an exemplary architecture for the clamped integrator shown in FIG. 2 that is useful for understanding the present invention.

Referring now to FIG. 3, there is provided a detailed block diagram of an exemplary embodiment of one element of the clamped integrator bank 222. As shown in FIG. 3, the clamped integrator 222 includes switches 308, 310, 312, an amplifier 306, an integrator 302, and comparators 314, 316. The switch 308 is controlled by an external device, such as the controller 230 of FIG. 2. For example, the switch 308 is opened when: the signal $Y_P(m)$ has an energy level equal to or below a noise floor level; and/or the signals $Y_P(m)$ and $Y_S(m)$ include voice. In contrast, the switch 308 is closed when the signals $Y_P(m)$ and $Y_S(m)$ include only far field noise. In this scenario, an input signal is passed to amplifier 306 causing its output to change. The input signal can include, but is not limited to, the signal outputs from comparator bank 220 of FIG. 2. The amplifier 306 sets the integrator rate by increasing the amplitude of the input signal by a certain amount. The amount by which the amplitude is increased can be based on a pre-determined value stored in a memory device (not shown). The amplified signal is then communicated to the integrator 302.

The magnitude of a signal output from the integrator 302 is then analyzed by components 314, 316, 310, 312 to determine if it has a value falling outside a desired range (e.g., 0.354 to 0.707). If the magnitude is less than a minimum value of said desired range, then the magnitude of the output signal of the integrator is set equal to the minimum value. If the magnitude is greater than a maximum value of said desired range, then the magnitude of the output signal of the integrator is set equal to the maximum value. In this way, the amount of gain adjustment by the clamped integrator bank 222 is constrained so that the difference between the gains of first and second transducer systems is always less than or equal to a pre-defined value (e.g., 6 dB).

Exemplary Communication System Implementation of the Present Invention

The present invention can be implemented in a communication system, such as that disclosed in U.S. Patent Publication No. 2010/0232616 to Chamberlain et al. ("Chamberlain"), which is incorporated herein by reference. A discussion is provided below regarding how the present invention can be implemented in the communication system of Chamberlain.

Figure 4:
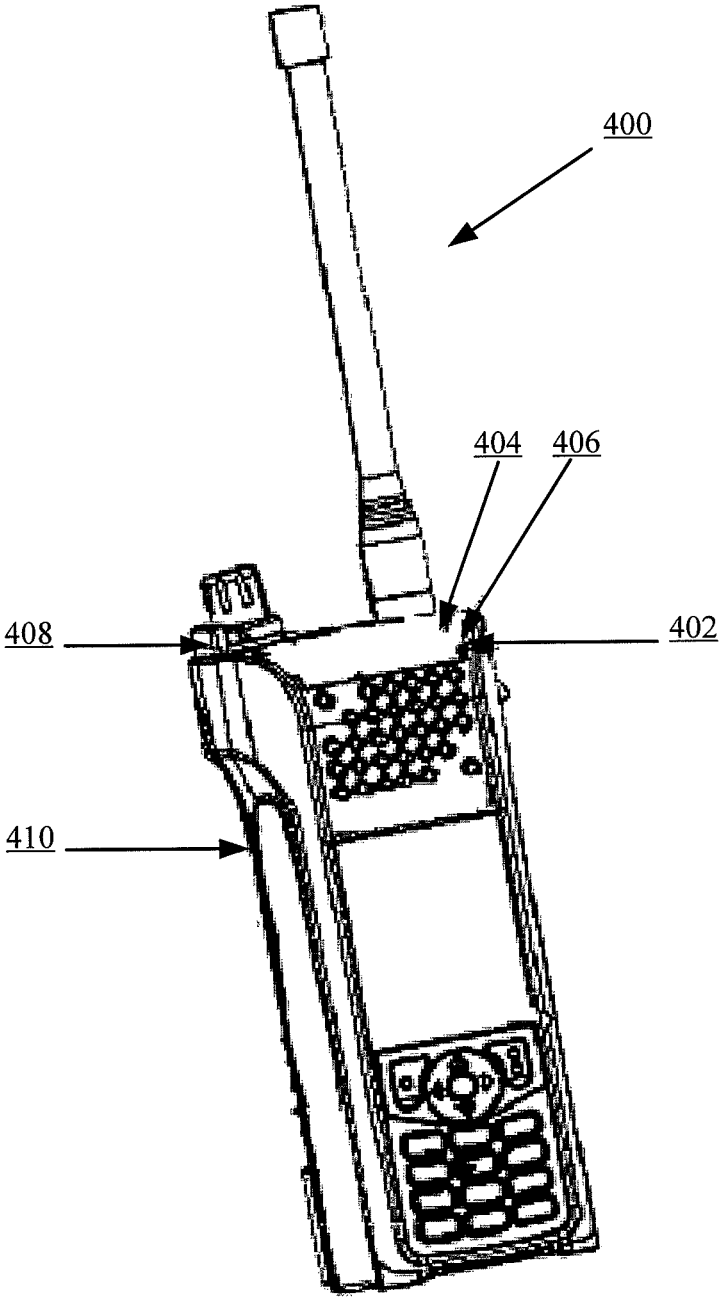
FIG. 4 is a front perspective view of an exemplary communication device implementing the present invention that is useful for understanding the present invention.
Figure 5:
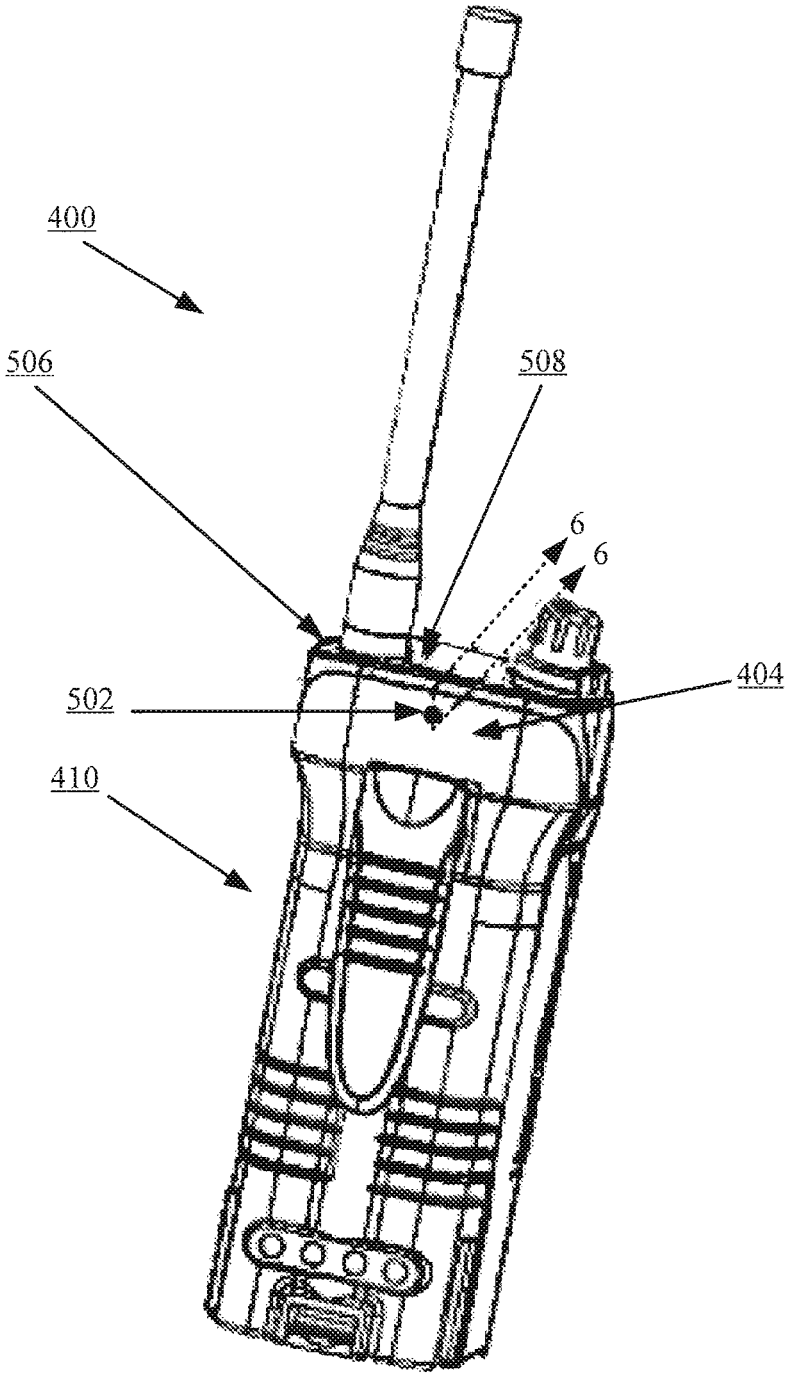
FIG. 5 is a back perspective view of the exemplary communication device shown in FIG. 4.

Referring now to FIGS. 4-5, there are provided front and back perspective views of an exemplary communications device 400 employing the present invention. The communications device 400 can include, but is not limited to, a radio (e.g., a land mobile radio), a mobile phone, a cellular phone, or other wireless communication device.

As shown in FIGS. 4-5, the communication device 400 comprises a first microphone 402 disposed on a front surface 404 thereof and a second microphone 502 disposed on a back surface 504 thereof. The microphones 402, 502 are arranged on the surfaces 404, 504 so as to be parallel with respect to each other. The presence of the noise waveform in a signal generated by the second microphone 502 is controlled by its "audio" distance from the first microphone 402. Accordingly, each microphone 402, 502 can be disposed a distance from a peripheral edge 408, 508 of a respective surface 404, 504. The distance can be selected in accordance with a particular application. For example, microphone 402 can be disposed ten (10) millimeters from the peripheral edge 408, 508 of surface 404. Microphone 502 can be disposed four (4) millimeters from the peripheral edge 408, 508 of surface 504.

According to embodiments of the present invention, each of the microphones 402, 502 is a MicroElectroMechanical System (MEMS) based microphone. More particularly, each of the microphones 402, 502 is a silicone MEMS microphone having a part number SMM310 which is available from Infineon Technologies North America Corporation of Milpitas, Calif.

The first and second microphones 402, 502 are placed at locations on surfaces 404, 504 of the communication device 400 that are advantageous to noise cancellation. In this regard, it should be understood that the microphones 402, 502 are located on surfaces 404, 504 such that they output the same signal for far field sound. For example, if the microphones 402 and 502 are spaced four (4) inches from each other, then an interfering signal representing sound emanating from a sound source located six (6) feet from the communication device 400 will exhibit a power (or intensity) difference between the microphones 404, 504 of less than half a decibel (0.5 dB). The far field sound is generally the background noise that is to be removed from the primary mixed input signal $Y_P(m)$. According to embodiments of the present invention, the microphone arrangement shown in FIGS. 4-5 is selected so that far field sound is sound emanating from a source residing a distance of greater than three (3) or six (6) feet from the communication device 400.

The microphones 402, 502 are also located on surfaces 404, 504 such that microphone 402 has a higher level signal than the microphone 502 for near field sound. For example, the microphones 402, 502 are located on surfaces 404, 504 such that they are spaced four (4) inches from each other. If sound is emanating from a source located one (1) inch from the microphone 402 and four (4) inches from the microphone 502, then a difference between power (or intensity) of a signal representing the sound and generated at the microphones 402, 502 is twelve decibels (12 dB). The near field sound is generally the voice of a user. According to embodiments of the present invention, the near field sound is sound occurring a distance of less than six (6) inches from the communication device 400.

The microphone arrangement shown in FIGS. 4-5 can accentuate the difference between near and far field sounds. Accordingly, the microphones 402, 502 are made directional so that far field sound is reduced in relation to near field sound in one (1) or more directions. The microphone 402, 502 directionality can be achieved by disposing each of the microphones 402, 502 in a tube (not shown) inserted into a through hole 406, 506 formed in a surface 404, 504 of the communication device's 400 housing 410.

Figure 6:
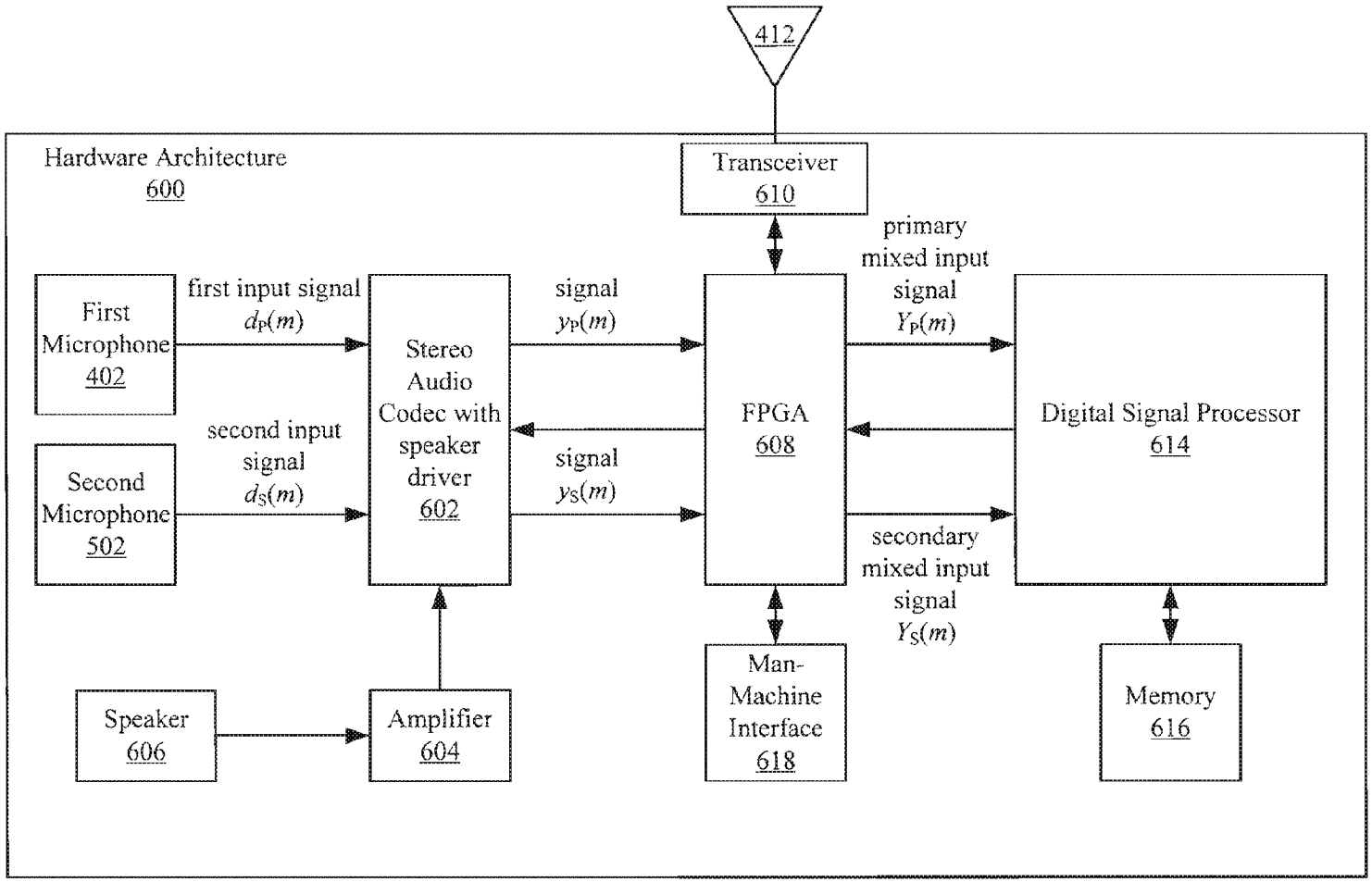
FIG. 6 is a block diagram illustrating an exemplary hardware architecture of the communication device shown in FIGS. 4-5 that is useful for understanding the present invention.

Referring now to FIG. 6, there is provided a block diagram of an exemplary hardware architecture 600 of the communication device 400. As shown in FIG. 6, the hardware architecture 600 comprises the first microphone 402 and the second microphone 502. The hardware architecture 600 also comprises a Stereo Audio Codec (SAC) 602 with a speaker driver, an amplifier 604, a speaker 606, a Field Programmable Gate Array (FPGA) 608, a transceiver 601, an antenna element 612, and a Man-Machine Interface (MMI) 618. The MMI 618 can include, but is not limited to, radio controls, on/off switches or buttons, a keypad, a display device, and a volume control. The hardware architecture 600 is further comprised of a Digital Signal Processor (DSP) 614 and a memory device 616.

The microphones 402, 502 are electrically connected to the SAC 602. The SAC 602 is generally configured to sample input signals coherently in time between the first and second input signal $d_P(m)$ and $d_S(m)$ channels. As such, the SAC 602 can include, but is not limited to, a plurality of ADCs that sample at the same sample rate (e.g., eight or more kilo Hertz). The SAC 602 can also include, but is not limited to, Digital-to-Analog Convertors (DACs), drivers for the speaker 606, amplifiers, and DSPs. The DSPs can be configured to perform equalization filtration functions, audio enhancement functions, microphone level control functions, and digital limiter functions. The DSPs can also include a phase lock loop for generating accurate audio sample rate clocks for the SAC 602. According to an embodiment of the present invention, the SAC 602 is a codec having a part number WAU8822 available from Nuvoton Technology Corporation America of San Jose, Calif.

As shown in FIG. 6, the SAC 602 is electrically connected to the amplifier 604 and the FPGA 608. The amplifier 604 is generally configured to increase the amplitude of an audio signal received from the SAC 602. The amplifier 604 is also configured to communicate the amplified audio signal to the speaker 606. The speaker 606 is generally configured to convert the amplifier audio signal to sound. In this regard, the speaker 606 can include, but is not limited to, an electro acoustical transducer and filters.

The FPGA 608 is electrically connected to the SAC 602, the DSP 614, the MMI 618, and the transceiver 610. The FPGA 608 is generally configured to provide an interface between the components 602, 614, 618, 610. In this regard, the FPGA 608 is configured to receive signals $y_P(m)$ and $y_S(m)$ from the SAC 602, process the received signals, and forward the processed signals $Y_P(m)$ and $Y_S(m)$ to the DSP 614.

The DSP 614 generally implements the present invention described above in relation to FIGS. 1-2, as well as a noise cancellation technique. As such, the DSP 614 is configured to receive the primary mixed input signal $Y_P(m)$ and the secondary mixed input signal $Y_S(m)$ from the FPGA 608. At the DSP 614, the primary mixed input signals $Y_P(m)$ is processed to reduce the amplitude of the noise waveform $n_P(m)$ contained therein or eliminate the noise waveform $n_P(m)$ therefrom. This processing can involve using the secondary mixed input signal $Y_S(m)$ in a modified spectral subtraction method. The DSP 614 is electrically connected to memory 616 so that it can write information thereto and read information therefrom. The DSP 614 will be described in detail below in relation to FIG. 7.

The transceiver 610 is generally a unit which contains both a receiver (not shown) and a transmitter (not shown). Accordingly, the transceiver 610 is configured to communicate signals to the antenna element 612 for communication to a base station, a communication center, or another communication device 400. The transceiver 610 is also configured to receive signals from the antenna element 612.

Figure 7:
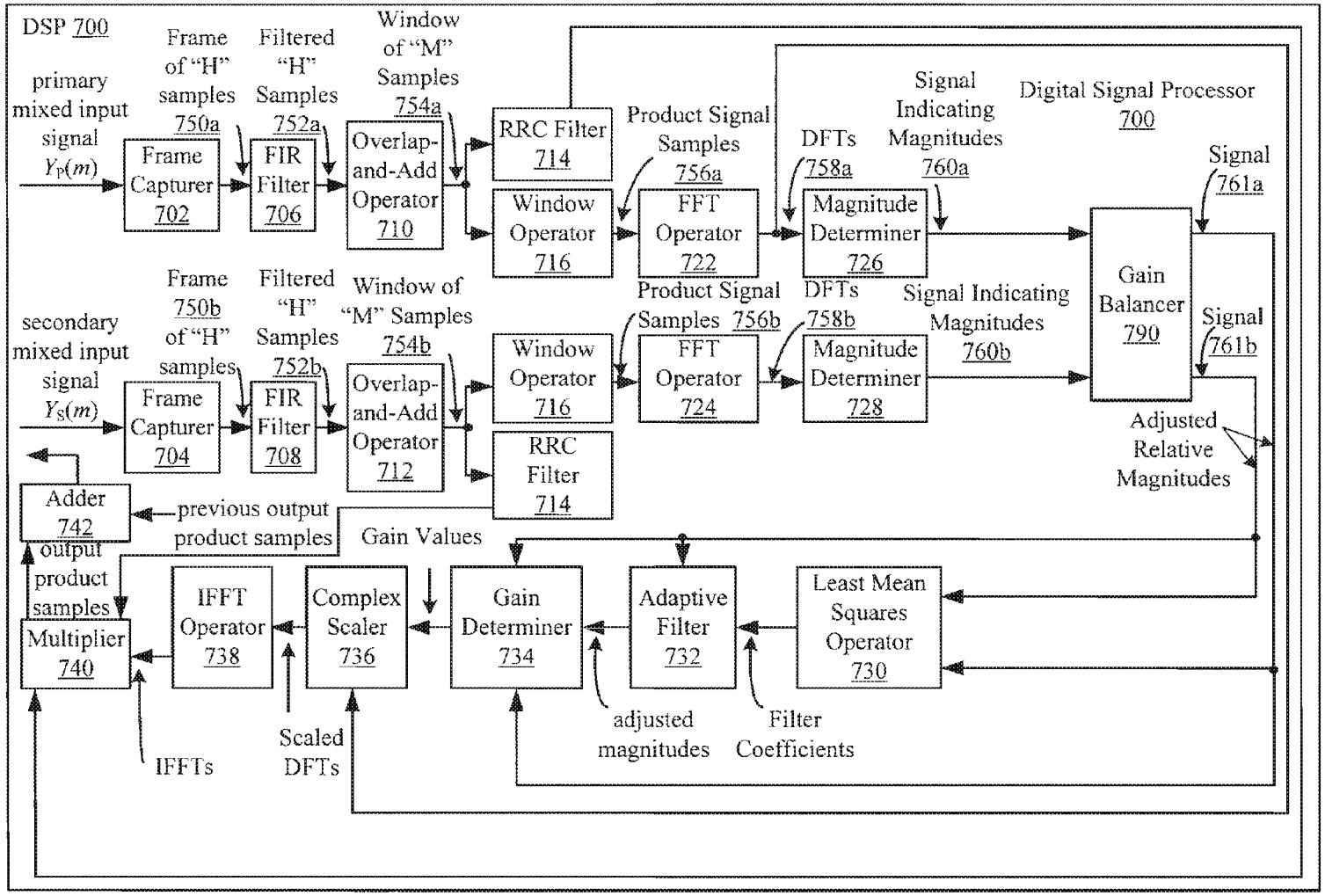
FIG. 7 is a more detailed block diagram of the digital signal processor shown in FIG. 6 that is useful for understanding the present invention.

Referring now to FIG. 7, there is provided a more detailed block diagram of the DSP 614 shown in FIG. 6 that is useful for understanding the present invention. As noted above, the DSP 614 generally implements the present invention described above in relation to FIGS. 1-2, as well as a noise cancellation technique. Accordingly, the DSP 614 comprises frame capturers 702, 704, FIR filters 706, 708, Overlap-and-Add (OA) operators 710, 712, RRC filters 714, 718, and windowing operators 716, 720. The DSP 614 also comprises FFT operators 722, 724, magnitude determiners 726, 728, an LMS operator 730, and an adaptive filter 732. The DSP 614 is further comprised of a gain determiner 734, a Complex Sample Scaler (CSS) 736, an IFFT operator 738, a multiplier 740, and an adder 742. Each of the components 702, 704, . . . , 742 shown in FIG. 7 can be implemented in hardware and/or software.

Each of the frame capturers 702, 704 is generally configured to capture a frame 750*a*, 750*b* of "H" samples from the primary mixed input signal $Y_P(m)$ or the secondary mixed input signal $Y_S(m)$. Each of the frame capturers 702, 704 is also configured to communicate the captured frame 750*a*, 750*b* of "H" samples to a respective FIR filter 706, 708. FIR filters are well known in the art, and therefore will not be described in detail herein. However, it should be understood that each of the FIR filters 706, 708 is configured to filter the "H" samples from a respective frame 750*a*, 750*b*. The filtration operations of the FIR filters 706, 708 are performed: to compensate for mechanical placement of the microphones 402, 502; and to compensate for variations in the operations of the microphones 402, 502. Upon completion of said filtration operations, the FIR filters 706, 708 communicate the filtered "H" samples 752*a*, 752*b* to a respective OA operator 710, 712.

Each of the OA operators 710, 712 is configured to receive the filtered "H" samples 752*a*, 752*b* from an FIR filter 706, 708 and form a window of "M" samples using the filtered "H" samples 752*a*, 752*b*. Each of the windows of "M" samples 754*a*, 754*b* is formed by: (a) overlapping and adding at least a portion of the filtered "H" samples 752*a*, 752*b* with samples from a previous frame of the signal $Y_P(m)$ or $Y_S(m)$; and/or (b) appending the previous frame of the signal $Y_P(m)$ or $Y_S(m)$ to the front of the frame of the filtered "H" samples 752*a*, 752*b*.

The windows of "M" samples 754*a*, 754*b* are then communicated from the OA operators 710, 712 to the RRC filters 714, 718 and windowing operators 716, 720. The RRC filters 714, 718 perform RRC filtration operations over the windows of "M" samples 754*a*, 754*b*. The results of the filtration operations (also referred to herein as the "RRC" values") are communicated from the RRC filters 714, 718 to the multiplier 740. The RRC values facilitate the restoration of the fidelity of the original samples of the signal $Y_P(m)$.

Each of the windowing operators 716, 720 is configured to perform a windowing operation using a respective window of "M" samples 754*a*, 754*b*. The result of the windowing operation is a plurality of product signal samples 756*a* or 756*b*. The product signal samples 756*a*, 756*b* are communicated from the windowing operators 716, 720 to the FFT operators 722, 724, respectively. Each of the FFT operators 722, 724 is configured to compute DFTs 758*a*, 758*b* of respective product signal samples 756*a*, 756*b*. The DFTs 758*a*, 758*b* are communicated from the FFT operators 722, 724 to the magnitude determiners 726, 728, respectively. At the magnitude determiners 726, 728, the DFTs 758*a*, 758*b* are processed to determine magnitudes thereof, and generate signals 760*a*, 760*b* indicating said magnitudes. The signals 760*a*, 760*b* are communicated from the magnitude determiners 726, 728 to the amplifiers 792, 794. The output signals 761*a*, 761*b* of the amplifiers 792, 794 are communicated to the gain balancer 790. The output signal 761*a* of amplifier 208 is also communicated to the LMS operator 730 and the gain determiner 734. The output signal 761*b* of amplifier 792 is also communicated to the LMS operator 730, adaptive filter 732, and gain determiner 734. The processing performed by components 730-742 will not be described herein. The reader is directed to above-referenced patent application (i.e., Chamberlain) for understanding the operations of said components 730-742. However, it should be understood that the output of the adder 742 is a plurality of signal samples representing the primary mixed input signal $Y_P(m)$ having reduced noise signal $n_P(m)$ amplitudes. The noise cancellation performance of the DSP 700 is improved at least partially by the utilization of the gain balancer 790.

Figure 8:
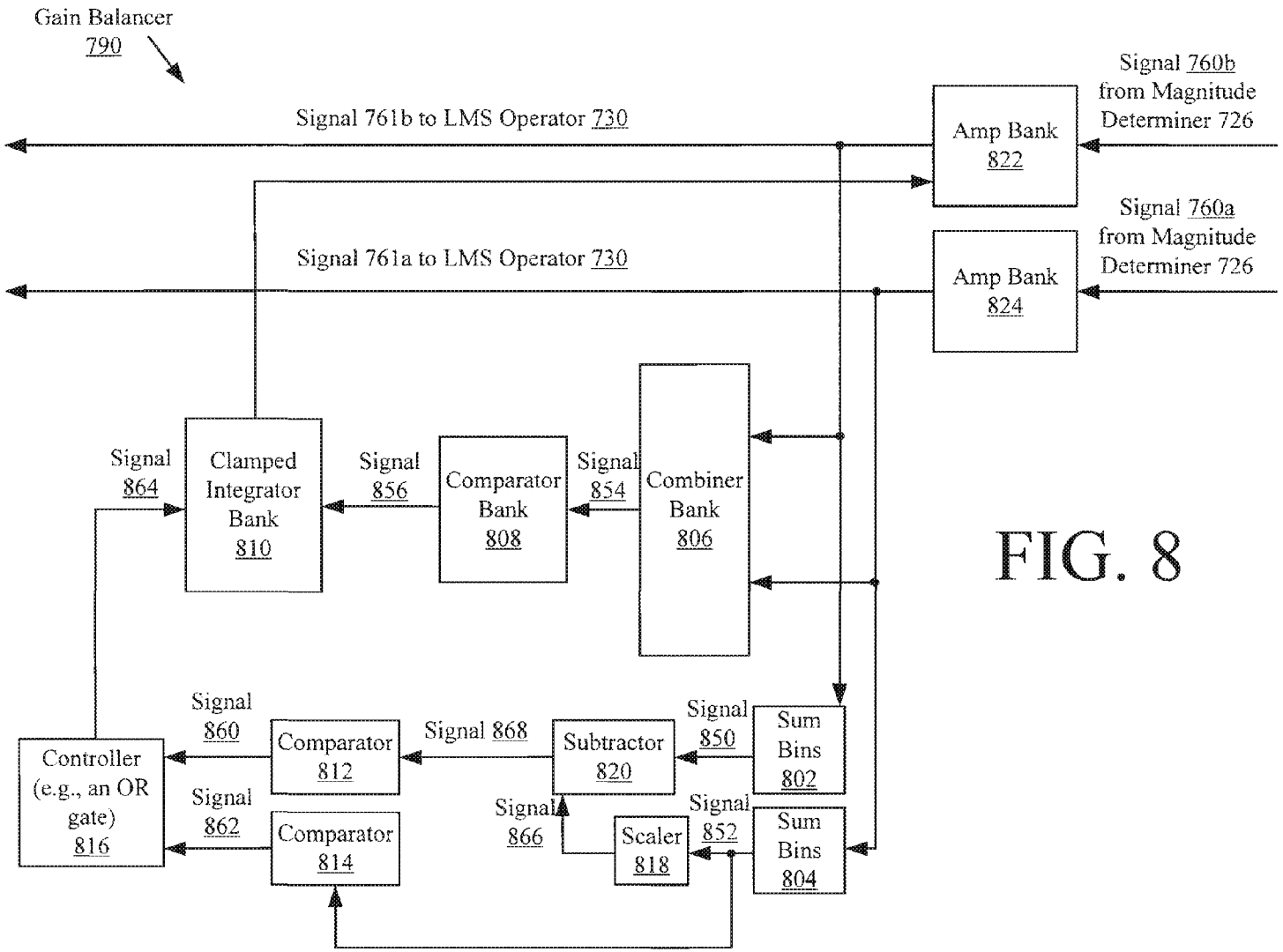
FIG. 8 is a detailed block diagram of the gain balancer shown in FIG. 7 that is useful for understanding the present invention.

The gain balancer 790 implements the method 100 discussed above in relation to FIG. 1. A detailed block diagram of the gain balancer 790 is provided in FIG. 8. As shown in FIG. 8, the gain balancer 790 comprises sum bins 802, 804, AMP banks 822, 824, a scaler 818, a subtractor 820, a combiner bank 806, a comparator bank 808, comparators 812, 814, a clamped integrator bank 810 and a controller 816.

The amp bank 822 is configured to receive the signal 760*b* from the magnitude determiner 728 of FIG. 7. The sum bins 802 processes the signals from the output of the amp bank 822 to determine an average magnitude for the "H" samples of the frame 750*b*. The sum bins 802 then generates a signal 850 with a value representing the average magnitude value. The signal 850 is communicated from the sum bins 802 to the subtractor 820.

The amp bank 824 is similar to the amp bank 822. Amp bank 824 is configured to: receive the signal 761*a* from the magnitude determiner 726 of FIG. 7; process the signal 761*a* with a gain factor; pass the resulting signals to sum bins 804; determine an average magnitude for the "H" samples of the frame 750*a* using sum bins 804; generate a signal 852 with a value representing the average magnitude value; scale the signal with the scaler 818, and communicate the scaled signal 866 to subtractor 820.

The combiner bank 806 combines the signals 761*a*, 761*b* to produce a combined signals 854. The combiner bank 806 can include, but is not limited to, a signal subtractor. Signals 854 are passed to the comparator bank 808 where a value thereof is compared to a threshold value (e.g., zero). The comparator 808 can include, but is not limited to, an operational amplifier voltage comparator. If the level of the combined signal 854 is greater than the threshold value, then the comparator 808 outputs a signal 856 with a level (+1.0) indicating that the associated clamped integrator in clamped integrator bank 810 should be incremented, and thus cause the gain of the associated amplifier amp bank 822 to be increased. If the level of the combined signal 854 is less than the threshold value, then the comparator 808 outputs a signal with a voltage level (e.g., −1.0) indicating that the associated clamped integrator in clamped integrator bank 810 should be decremented, and thus cause the gain of the amplifier in amp bank 822 to be decreased.

The signals 856 output from comparator bank 808 are communicated to the clamped integrator bank 810. The clamped integrator bank 810 is generally configured for controlling the gain of the amp bank 822. More particularly, each clamped integrator in the clamped integrator bank 810 selectively increments and decrements the gain of the associated amplifier in the amp bank 822 by a certain amount. The amount by which the gain is changed can be defined by a pre-stored value (e.g., 0.01 dB). The clamped integrator bank 810 is the same as or similar to the clamped integrator bank 222 of FIGS. 2-3. As such, the description provided above is sufficient for understanding the operations of the clamped integrator 810 of FIG. 8.

The clamped integrator bank 810 is selectively enabled and disabled based on the results of a determination as to whether or not the signals $Y_P(m)$, $Y_S(m)$ include only far field noise. The determination is made by components 802, 804 and 812-818 of the gain balancer 790. The operation of components 802, 804 and 812-818 will now be described.

The signal 850 output from sum bins 802 is subtracted from the signal 852 output from sum bins 804 scaled by scaler 818. The subtracted signal 868 is communicated to the comparator 812 where it's level is compared to a threshold value (e.g., zero). If the level exceeds the threshold value, then it is determined that the signals $Y_P(m)$ and $Y_S(m)$ include voice. In this scenario, the comparator 812 outputs a signal 860 with a level (e.g., +1.0) indicating that the signals $Y_P(m)$ and $Y_S(m)$ include voice. If the level is less than the threshold value, then it is determined that the signals $Y_P(m)$ and $Y_S(m)$ do not include voice. In this scenario, the comparator 812 outputs a signal 860 with a level (e.g., 0) indicating that the signals $Y_P(m)$ and $Y_S(m)$ do not include voice. The comparator 812 can include, but is not limited to, an operational amplifier voltage comparator.

As previously described, sum bins 804 produce a signal 852 representing the average magnitude for the "H" samples of the frame 750*a*. Signal 852 is then communicated to the comparator 814 where it's level is compared to a threshold value (e.g., 0.01). If the level of signal 852 is less than the threshold value, then it is determined that the input signal is "noisy". The comparator 858 can include, but is not limited to, an operational amplifier voltage comparator.

The signals 860, 862 output from comparators 812, 814 are communicated to the controller 816. The controller 816 allows the clamped integrator 810 to change when the signals $Y_P(m)$ and $Y_S(m)$ do not include voice; and/or are not "noisy". The controller 816 can include, but is not limited to, an OR gate.

In light of the forgoing description of the invention, it should be recognized that the present invention can be realized in hardware, software, or a combination of hardware and software. A method for matching gain levels of transducers according to the present invention can be realized in a centralized fashion in one processing system, or in a distributed fashion where different elements are spread across several interconnected processing systems. Any kind of computer system, or other apparatus adapted for carrying out the methods described herein, is suited. A typical combination of hardware and software could be a general purpose computer processor, with a computer program that, when being loaded and executed, controls the computer processor such that it carries out the methods described herein. Of course, an application specific integrated circuit (ASIC), and/or a field programmable gate array (FPGA) could also be used to achieve a similar result.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

The word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is if, X employs A; X employs B; or X employs both A and B, then "X employs A or B" is satisfied under any of the foregoing instances.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

We claim:

1. A method for matching characteristics of two or more transducer systems, comprising:

receiving, at an electronic circuit, a first input signal from a first transducer system and a second input signal from a second transducer system;

determining, by said electronic circuit, if the first and second input signals comprise a voice signal containing speech of a relatively high volume;

determining by said electronic circuit, if the first input signal comprises a noisy signal containing speech or system noise of a relatively low volume by comparing an energy level of the first input signal directly to a pre-defined noise floor level of the system noise; and disabling balancing operations of the electronic circuit when at least one of the following is determined (1) the first and second input signals comprise said voice signal and (2) the first input signal comprises said noisy signal, where the balancing operations comprise balancing said matching characteristics of said transducer systems.

2. The method according to claim 1, further comprising:

dividing, by the electronic circuit, a spectrum into a plurality of frequency bands; and processing, by the electronic circuit, each of said frequency bands separately for addressing differences between operations of said transducer systems at different frequencies.

3. The method according to claim 1, wherein the transducer systems emit changing direct current signals.

4. The method according to claim 3, wherein at least one of the direct current signals represents an oxygen reading.

5. The method according to claim 1, wherein said balancing operations comprise constraining an amount of adjustment of a gain so that differences between gains of the transducer systems are less than or equal to a pre-defined value.

6. The method according to claim 1, wherein said balancing operations comprise constraining an amount of adjustment of a phase so that differences between phases of said transducer systems are less than or equal to a pre-defined value.

7. The method according to claim 1, wherein a gain of each of said transducer systems is adjusted by incrementing or decrementing during said balancing operations.

8. The method according to claim 1, wherein a phase of each of said transducer systems is adjusted by incrementing or decrementing a value thereof by a certain amount during said balancing operations.

9. The method according to claim 1, further comprising using, by said electronic circuit, said matching characteristics of a first one of said transducer systems as reference characteristics for adjustment of said matching characteristics of a second one of said transducer systems.

10. The method according to claim 1, wherein the balancing operations are disabled by at least one of a noise floor detector and a wanted signal detector when triggered.

11. The method according to claim 10, wherein the wanted signal detector is a voice energy detector.

12. The method according to claim 10, wherein a wanted signal is detected by said wanted signal detector when an imbalance in signal output levels of said transducer systems occurs.

13. A system comprising:

at least one electronic circuit configured to receive a first input signal from a first transducer system and a second input signal from a second transducer system, determine if the first and second input signals comprises a voice signal containing speech of a relatively high volume;

determine if the first input comprises a noisy signal containing speech or system noise of a relatively low volume by comparing an energy level of the first input signal directly to a pre-defined noise floor level of the system noise, and disabling balancing operations of the system when at least one of the following is determined (1) the first and second input signals comprise said voice signal and (2) the first input signal comprises said noisy signal, where the balancing operations comprise balancing characteristics of said first and second transducer systems.

14. The system according to claim 13, wherein the electronic circuit is further configured to:

divide a spectrum into a plurality of frequency bands, and process each of said frequency bands separately for addressing differences between operations of said first and second transducer systems at different frequencies.

15. The system according to claim 13, wherein the first and second transducer systems emit changing direct current signals.

16. The system according to claim 15, wherein at least one of the direct current signals represents an oxygen reading.

17. The system according to claim 13, wherein said characteristics are balanced by constraining an amount of adjustment of a gain so that differences between gains of the first and second transducer systems are less than or equal to a pre-defined value.

18. The system according to claim 13, wherein said characteristics are balanced by constraining an amount of adjustment of a phase so that differences between phases of said first and second transducer systems are less than or equal to a pre-defined value.

19. The system according to claim 13, wherein said characteristics are balanced by incrementing or decrementing a gain of each of said first and second transducer systems.

20. The system according to claim 13, wherein said characteristics are balanced by incrementing or decrementing a value of a phase of each of said first and second transducer systems.

21. The system according to claim 13, wherein said electronic circuit is further configured to use said characteristics of a first one of said first and second transducer systems as reference characteristics for adjustment of said characteristics of a second one of said first and second transducer systems.

22. The system according to claim 13, further comprising a noise floor detector configured to disable adjustment operations of the electronic circuit when triggered.

23. The system according to claim 13, further comprising a wanted signal detector configured to disable adjustment operations of the electronic circuit when triggered.

24. The system according to claim 23, wherein the wanted signal detector is a voice energy detector.

25. The system according to claim 23, wherein a wanted signal is detected by said wanted signal detector when an imbalance in signal output levels of said first and second transducer systems occurs.

* * * * *